US012727691B2

(12) United States Patent
Kram

(10) Patent No.: US 12,727,691 B2
(45) Date of Patent: Sep. 8, 2026

(54) MULTI-LAYERED ANATOMICALLY ENGINEERED, 3 POSITION BED PILLOW, TO REDUCE SLEEP APNEA AND SNORING, WITH METHODS FOR DESIGN, MANUFACTURING AND USE

(71) Applicant: Anthony B Kram, Buffalo Grove, IL (US)

(72) Inventor: Anthony B Kram, Buffalo Grove, IL (US)

( * ) Notice: Subject to any disclaimer, the term of this patent is extended or adjusted under 35 U.S.C. 154(b) by 0 days.

(21) Appl. No.: 18/814,552

(22) Filed: Aug. 25, 2024

(65) Prior Publication Data

US 2026/0053286 A1 Feb. 26, 2026

(51) Int. Cl.
*A47G 9/10* (2006.01)

(52) U.S. Cl.
CPC ..... *A47G 9/109* (2013.01); *A47G 2009/1018* (2013.01)

(58) Field of Classification Search
CPC ..... A47G 9/10; A47G 9/1081; A47G 9/109; A47G 2009/1018
See application file for complete search history.

(56) References Cited

U.S. PATENT DOCUMENTS 3,243,828 A * 4/1966 Mccarty ..... A47G 9/10 5/636
3,694,831 A * 10/1972 Treace ..... A47G 9/10 5/636
4,494,261 A * 1/1985 Morrow ..... A47G 9/109 5/636
4,536,905 A * 8/1985 DeSantis ..... A47G 9/10 5/636
4,550,458 A * 11/1985 Fiore ..... A47G 9/109 5/640

(Continued)

FOREIGN PATENT DOCUMENTS

CA 3031286 A1 * 5/2020 ..... A61F 5/56
KR 101434817 B1 * 8/2014 ..... A61G 7/07
WO WO-2005032309 A1 * 4/2005 ..... A47G 9/10

OTHER PUBLICATIONS

Arunangshu Chakraborty , Ipsita Chattopadhyay and Jyotsna Goswami; Sniffing Position: Is it Just a Gas?; Oct. 12, 2018; Journal of Anaesthesiology and Critical Care (Year: 2018).*

(Continued)

*Primary Examiner* — David E Sosnowski
(74) *Attorney, Agent, or Firm* — Thompson Patent Law Offices PC

(57) ABSTRACT

The pillow is created to allow sleeping in three positions—left side, back side, and right side. The shapes and sizes of the pillow are taken from anatomical measurements of the body to support the sleeper's size, position and comfort needs. The side position is the height of the sleepers shoulder. The side positions top also tilts the face slightly upward and has a large divot for the ear. The center of the pillow is made for sleeping on the back. It raises the shoulders slightly, and supports the neck. Behind the neck support is a concave depression that will cradle and support the head. However, the pillow does not support the head until it is tilted backwards slightly. The backward tilt of the head should reduce snoring and sleep apnea. The pillow may have 3 layers—base layer, cushion layer, and contact layer.

7 Claims, 4 Drawing Sheets

(56) References Cited

U.S. PATENT DOCUMENTS 4,768,246 A * 9/1988 Summer ..... A47G 9/10 5/636
4,908,894 A * 3/1990 Sanders ..... A47G 9/10 5/640
5,018,231 A * 5/1991 Wang ..... A47G 9/10 5/636
D376,288 S * 12/1996 Antonian ..... D6/601
5,781,947 A * 7/1998 Sramek ..... A47G 9/109 5/636
5,920,932 A * 7/1999 Hershgordon ..... A61F 5/56 5/636
5,926,879 A * 7/1999 Davis ..... A47G 9/1081 5/636
5,926,880 A * 7/1999 Sramek ..... A47G 9/10 5/636
6,029,295 A * 2/2000 Larmour ..... A47G 9/10 5/636
6,401,279 B1 * 6/2002 Vaughn ..... A47G 9/10 5/644
6,446,288 B1 * 9/2002 Pi ..... A61G 7/072 5/636
6,671,906 B1 * 1/2004 Milligan ..... A47G 9/10 5/636
8,161,588 B1 * 4/2012 Anson ..... A47G 9/109 5/636
8,566,985 B2 * 10/2013 Kim ..... A47G 9/109 5/636
8,677,531 B2 * 3/2014 Popitz ..... A47G 9/1081 5/636
8,893,334 B1 * 11/2014 Wong ..... A47G 9/109 5/636
9,032,961 B2 * 5/2015 Zhang ..... A47G 9/10 5/636
9,095,231 B2 * 8/2015 Abdo ..... A47G 9/1009
9,247,837 B1 * 2/2016 Blake ..... A47G 9/1081
9,820,593 B2 * 11/2017 Adams ..... A47G 9/1081
10,455,957 B2 * 10/2019 Wang ..... A47G 9/1036
10,888,183 B2 * 1/2021 Popitz ..... A61F 5/56
10,898,015 B2 * 1/2021 Popitz ..... A61G 7/072
10,943,280 B2 * 3/2021 King ..... A47G 9/10
2017/0128307 A1 * 5/2017 Kim ..... A61F 5/04
2017/0156958 A1 * 6/2017 Roh ..... A47G 9/109
2019/0069698 A1 * 3/2019 Lin ..... A47G 9/1009
2020/0155396 A1 * 5/2020 Popitz ..... A47G 9/10
2021/0037996 A1 * 2/2021 Liu ..... A47G 9/1054
2021/0298499 A1 * 9/2021 Kim ..... A61F 7/02
2021/0361094 A1 * 11/2021 Uribe ..... A47G 9/109
2022/0202212 A1 * 6/2022 Kim ..... A47G 9/109
2023/0190017 A1 * 6/2023 Lalo ..... A47G 9/1081 5/636
2024/0138600 A1 * 5/2024 Tantisari ..... A47G 9/109
2024/0251974 A1 * 8/2024 Tsunoda ..... A47G 9/1081
2024/0389771 A1 * 11/2024 Fan ..... A47G 9/109

OTHER PUBLICATIONS

Chakraborty, Arunangshu, et al.; "Sniffing Position: Is it Just a Gas?"; Journal of Anaesthesiology and Critical Care; Oct. 12, 2018; vol. 1 No. 3:12; 5 pages.
Greenland, K.B., et al.; "The Origins of the Sniffing Position and the Three Axes Alignment Theory for Direct Laryngoscopy"; Anaesthesia and Intensive Care, vol. 36, Supplement 1; Jul. 2008; 5 pages.
El-Orbany, Mohammad, et al. "Head and neck position for direct laryngoscopy." Anesthesia Analgesia, vol. 113, No. 1, Jul. 2011, pp. 103-109, https://doi.org/10.1213/ane.0b013e31821c7e9c.

* cited by examiner

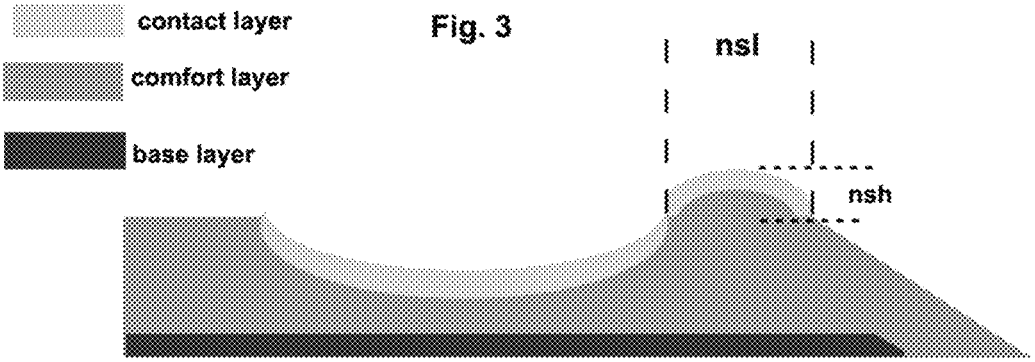
Fig. 3
Fig. 4 Back Sniff Position
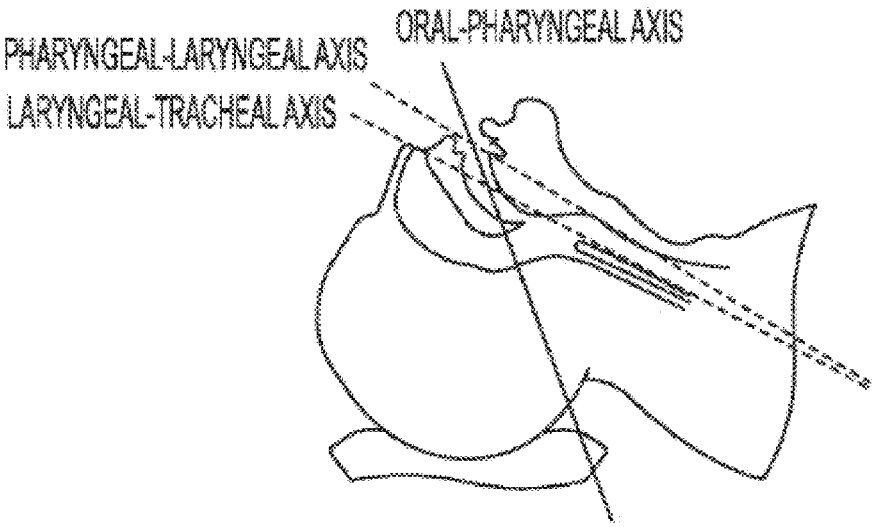

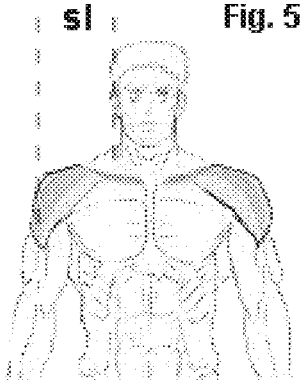
Fig. 5
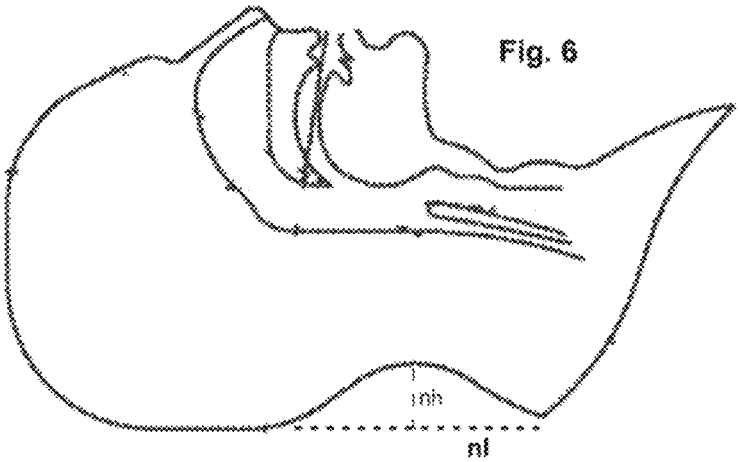
Fig. 6
Fig. 7
Side Sniff Position
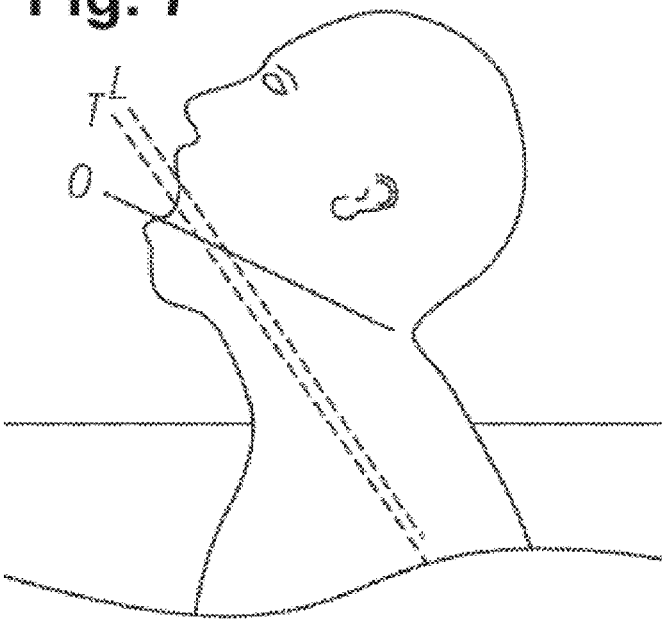

MULTI-LAYERED ANATOMICALLY ENGINEERED, 3 POSITION BED PILLOW, TO REDUCE SLEEP APNEA AND SNORING, WITH METHODS FOR DESIGN, MANUFACTURING AND USE

US PATENTS

| Patent number | date issued | inventor | CLC code |
|---|---|---|---|
| 5,781,947 | Jul. 21, 1998 | Sramek | 5/636 |
| 5,926,880 | Jul. 27, 1999 | Sramek | 5/636 |
| 6,671,906 | Jan. 6, 2004 | Milligan | 5/636 |
| 8,566,985 | Oct. 29, 2013 | Kim | 5/636 |
| 9,032,961 | May 19, 2015 | Zhang | 5/640 |
| 10,898,015 | Jan. 26, 2021 | Popitz, et al. | A47G 9 |
| 4,494,261 | Jan. 22, 1985 | Morrow | 5/436 |
| 3,243,828 | Apr. 5, 1966 | McCarty | 5/338 |
| 4,536,905 | Aug. 27, 1985 | DeSantis, Damian | 5/636 |
| 4,768,246 | Sep. 6, 1988 | Summer | 5/640 |
| 4,908,894 | Mar. 20, 1990 | Sanders | 5/640 |
| 5,018,231 | May 28, 1991 | Wang | 5/636 |
| 5,920,932 | Jul. 13, 1999 | Hershgordon | 5/636 |
| 5,926,879 | Jul. 27, 1999 | Davis | 5/636 |
| 6,029,295 | Feb. 29, 2000 | Larmour, et al. | 5/636 |
| 6,401,279 | Jun. 11, 2002 | Vaughn | 5/644 |
| 8,893,334 | Nov. 25, 2014 | Wong | 5/640 |
| 8,677,531 | Mar. 25, 2014 | Popitz | 5/638 |
| 9,095,231 | Aug. 4, 2015 | Abdo | A47G2009 |
| 9,820,593 | Nov. 21, 2017 | Adams | A47G9 |
| 10,455,957 | Oct. 29, 2019 | Wang, et al. | A47G9 |
| 10,888,183 | Jan. 12, 2021 | Popitz, et al. | A61G7 |
| 10,943,280 | Mar. 9, 2021 | King | A47G 9 |

FOREIGN PATENTS

| Patent number | date issued | inventor | CLC code |
|---|---|---|---|
| D376,288 | Dec. 10, 1996 | Antonian | D6/601 |

DOCUMENT REFERENCES

SNIFF Position:

https://www.uclahealth.org/head-neck-surgery/workfiles/Secure/El-Orbany-DL-2011.pdf https://www.imedpub.com/articles/sniffing-position-is-it-just-a-gas.php?aid=23442 https://journals.sagepub.com/doi/pdf/10.1177/0310057X0803601s05

CLASSIFICATIONS

Current U.S. Class: 5/640; 5/622; 5/638; 5/655.9; 5/637; 5/636

Current CPC Class: A47G 9/109 (20130101)

Current International A47C 20/00 (20060101)

Class:

Field of Search: 5/622, 630, 636, 637, 638, 652, 655.9, 640

STATEMENT RE: FEDERALLY SPONSORED RESEARCH (Not Applicable)

BACKGROUND OF THE INVENTION

This invention pertains to the field of sleeping bed pillows, in particular, orthopedic/therapeutic support pillows that provide support for the head and neck region. I hesitate to call this an orthopedic pillow because it implies "expensive" and this pillow can be reproduced inexpensively with the included design and manufacturing suggestions.

Previous pillows failed to totally take into account the multiplicity of factors, and needs of a sleeper such as the size, position, and comfort. They often provide a solution for sleeping in one position so sleepers often use two pillows to compensate. Even sleeping with one pillow, on your back, can push the head up and forward so the chin touches the chest thus forcing a closing of the throat and causing sleep apnea or snoring. When sleeping on a side, the pillow is usually too low or high. This will result in a crick in the neck the next morning and poor sleep with snoring and possibly sleep apnea. This pillow corrects all those problems and others.

BRIEF SUMMARY OF THE INVENTION

The pillow is created to allow sleeping in three positions-left side, back side, and right side. The shape and sizes of the pillow are taken from anatomical measurements of the body to support the sleeper's size, position and comfort needs. The side position tower is sized to the height of the sleeper's shoulder. The top of the tower also tilts the face slightly upward to cause drool to go down the throat, instead of out the mouth. The top surface also has a large crescent divot to reduce pressure on the ear. The left side tower and right side tower positions are mirror images of each other. The center of the pillow is made for sleeping on the back. It raises the back slightly, and supports the neck. Behind the neck support is a concave depression that will cradle and support the head. However, the pillow depression is designed so it does not support the head until it is tilted backwards slightly. This will force the sleeper into a position that opens the mouth and neck to reduce throat constriction, thus reducing the possibility of snoring and sleep apnea. The pillow, as a whole, may have 3 layers—base layer, cushion layer, and contact layer. The base layer is a firm material that gives the pillow a solid foundation. The comfort layer is a softer material that conforms to the shape of the sleeper. The contact layer is to provide the maximum comfort to the sleeper's skin.

What Distinguishes this Pillow from Other Inventions:

It combines several diverse ideas into one device and adds new ideas to make it most unique and useful to sleepers. The above mentioned reference patents generally do not put the head in the sniff position or are not anatomically designed.

Detailed Cutaway Drawings for Illustration Purposes

Figure 2:
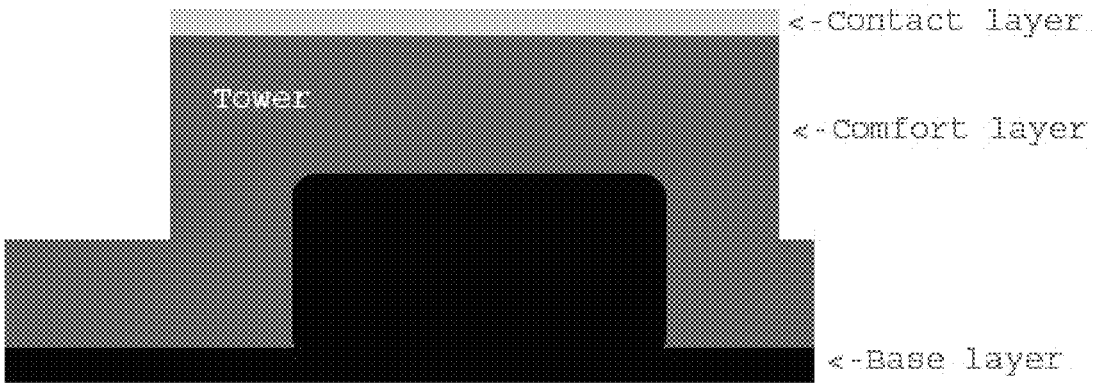

FIG. 2 is a detailed slice drawing of the side sleeping of pillow tower. Also shows the possible layering concept.

FIG. 3 is a detailed slice drawing of the center of the pillow for back sleeping position. Also shows the possible layering concept.

Concept Illustrations:

FIG. 4 shows the open throat position (sniff position) that the pillow enforces for the back sleeping position.

FIG. 5 shows how to achieve the shoulder measurements.

FIG. 6 shows how to achieve the neck measurement.

FIG. 7 shows the open throat position (sniff position) that the sleeper should achieve when side sleeping.

Figure 8A:
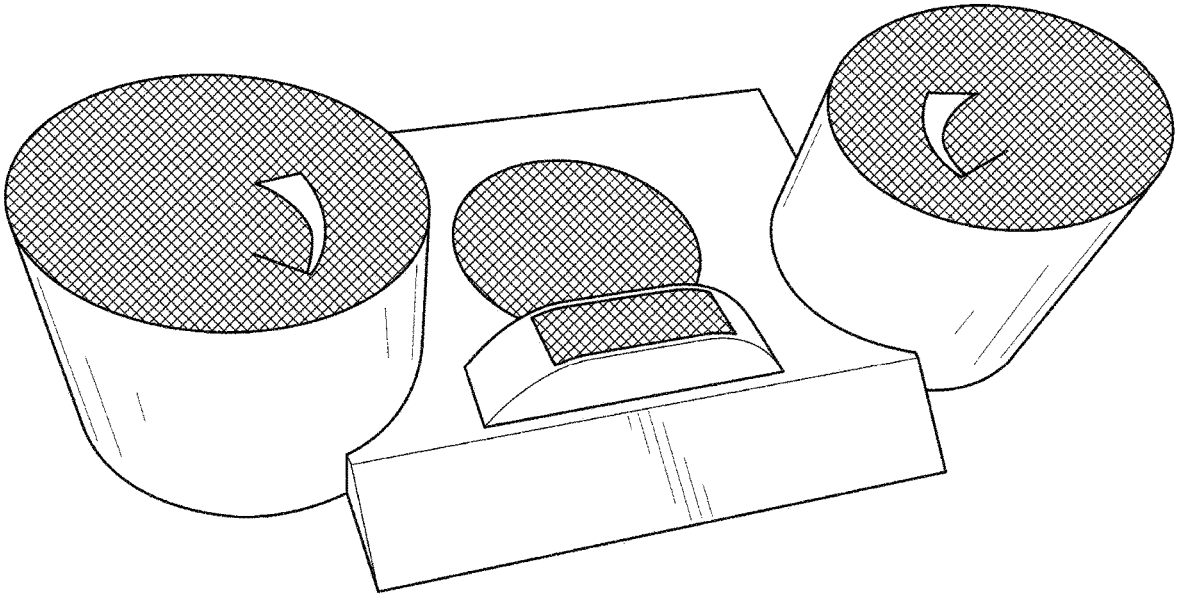
Figure 8B:
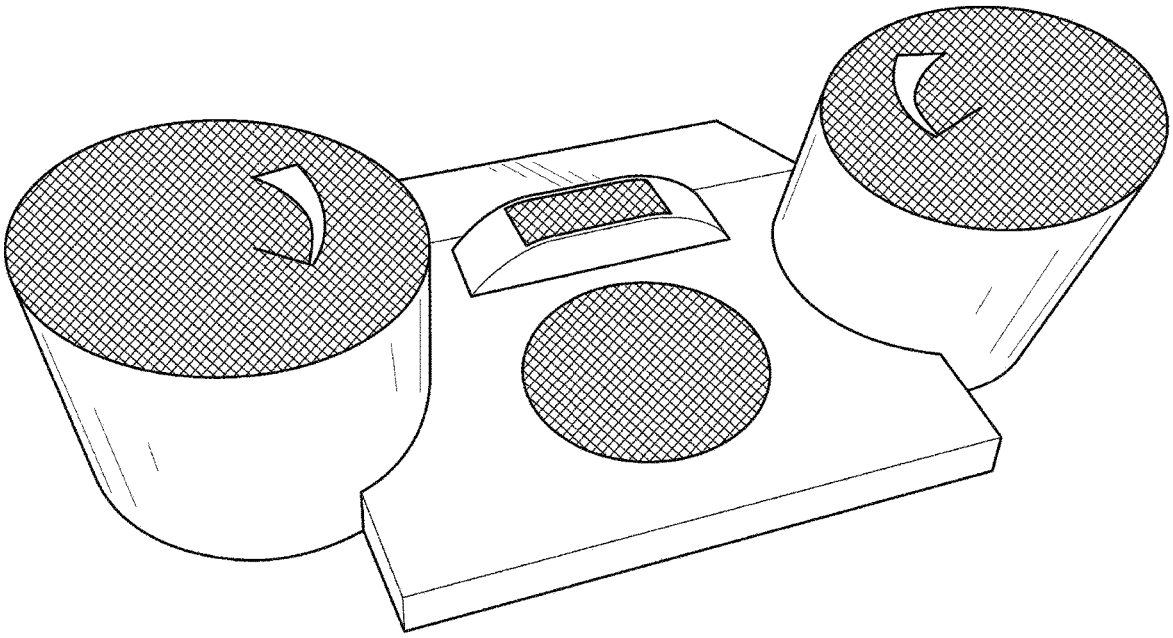

Exemplar Prototype Photo:

FIGS. 8 *a* and *b* are pictures of a prototype of the pillow.

DETAILED DESCRIPTION OF THE INVENTION

The pillow is created to allow sleeping in three positions-left side, back side, and right side. The shapes and sizes of the pillow are taken from anatomical measurements of the body to support the sleeper's size, position and comfort needs.

Side Position:

The side sleeping position of the pillow; henceforth referred as tower; is sized to the height of the sleeper's shoulder. The total height of the tower is the same length as the sleeper's shoulder, with compression of the pillow material used, taken into account.

Tower height (*th*) =

Shoulder length (*sl*) + compression of chosen material

Figure 1:
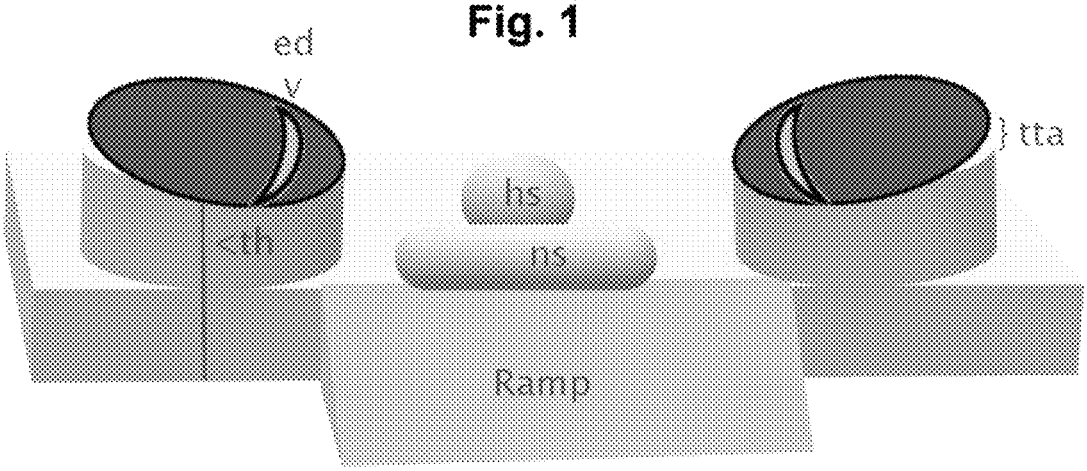
FIG. 1 is an overview picture of the whole pillow to show structure and/or shape.

See FIG. 1 and FIG. 5

The top of the tower also tilts the face slightly upward to cause drool to go down the throat instead of out the mouth. The angle of the tilt shall be between 5 and 15 degrees. Less than 5 degrees is not enough to raise the corner of the mouth above the throat for most sleepers. More than 15 degrees puts undue twist on the neck. Ten degrees was chosen as optimal for illustration purposes.

top tower angle (*tta*) = 10° degrees

See FIG. 1

The top surface of the tower also has a large crescent divot to reduce pressure on the ear. Refer to FIG. 1 ear divot (ed) The divot is elongated to allow the sleeper to sleep in many head tilt positions. This is also done so the sleeper can sleep with their head tilted back to attain the SNIFF position (see Document references) and reduce snoring and sleep apnea. See FIG. 7.

The left side tower and right side tower sleeping positions are mirror images of each other.

Back Position:

Between the left side position and the right side position towers is the center or back sleeping position. The center of the pillow is made for sleeping on the back or supine position. The pillow has a ramp which supports and raises the back of the sleeper slightly. The height of this is about 2 inches. Refer to FIG. 1. More on this later.

At the top of the ramp is the neck support. Refer to FIG. 1 (ns). The dimensions are also taken from anatomical measurements of the sleeper. Neck support height equals neck height plus material compression. Refer to FIG. 5. Neck support length equals neck length. Refer to FIG. 6. The whole compressed shape of the neck support is the same as the hollow created by the neck.

neck support height (*nsh*) = neck height (*nh*) + compression of chosen material

See FIG. 3 and FIG. 5 neck support length (*nsl*) = neck length (*nl*)

See FIG. 3 and FIG. 6

Behind the neck support is a concave depression that will cradle and support the head. However, the pillow does not support the head until it is tilted backwards slightly. Thus the structure of the pillow will force the sleeper into a position that opens the mouth and neck to reduce throat constriction, thus reducing the possibility of snoring and sleep apnea. This will automatically put the sleeper into the back SNIFF position. See FIG. 4. (see Document references on sniff position) The aforementioned ramp raises the shoulders thus allowing the head tilt to go below the level of the shoulders. See FIG. 1 (hs) for head support. The depression can be from 1-3 inches deep however it is best to stay 1-2 inches because the 2-3 inches depth is mentally awkward for most sleepers. The prototype uses 1.5 inches.

The pillow, as a whole, may have 1-3 or more layers—base layer, cushion layer, and contact layer. The base layer is a firm material that gives the pillow a solid foundation. The comfort layer is a softer material that conforms to the shape of the sleeper. The contact layer is to provide for the maximum comfort to the sleepers skin. See FIGS. 2 and 3 to see an example of how the layers may be laid out. Obviously thicknesses and density of each layer with a softer or firmer chosen materials will enhance the desired support and comfort for the sleeper.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to deploy the presented invention.

However, other relative proportions of shoulder portion 5 and neck portion 6 are fully contemplated. Furthermore, the pillow, FIG. 1 shown and described herein may have any length, width, and height proportion, such as to form a standard size pillow, a king size pillow, or any other size for the differences in sleepers such as small, medium and large etc.

Although not shown, a cover may be provided to enclose the pillow in FIG. 1. The cover may be constructed from any suitable material such as, but not limited to, cotton, silk, polyester, spandex, or other materials or combinations thereof.

DETAILED DESCRIPTION OF THE PREFERRED EMBODIMENTS

Some of the suggested materials for the layers could be polyurethane foams, viscoelastic memory foam, latex foam, cool gel, etc.

For illustration purposes the pillow tower is depicted as a circle. It could be an oval, square, or any ecstatically pleasing and comfortable shape. This also applies to any other shapes in the drawings.

Although particular embodiments of the invention have been described in detail for purposes of illustration, various modifications and enhancements may be made without departing from the spirit and scope of the invention. Accordingly, the invention is not to be limited except as by the appended claims.

The pillow may be built in small, medium, large, extra-large sizes and possibly a petite and XX-large sizes. All of the above measurements are not specific because each size would have different measurements. There may even be different measurements for the different markets around the world. The pillow could also be custom made to the measurements of a particular sleeper. In all cases the pillow should fit within the standard pillow case Several molds created from the aforementioned design specifications would allow for the fast manufacturing of a pillow; including the layering of different materials within the molds. The designed shape of the pillow should be made of smooth flowing lines (i.e. no corners) to allow for easy removal of the pillow from the mold.

To make this pillow in its fastest and cheapest form, only one layer, the comfort layer, is recommended. The pillow case would be considered the "contact layer" and no base layer would be needed.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. In fact it is recommended that the details change to customize the pillow to best suit the sleeper.

I claim:

1. A pillow comprising:

a compressible pillow material configured to deform under load applied by a user;

a central sleeping support region configured to support a head of the user in a supine sleeping position, the central sleeping support region comprising:

an elevated ramp configured to elevate shoulders of the user when the user lies on the central sleeping support region on a user's back;

a neck support member positioned adjacent an upper end of the elevated ramp, the neck support member comprising:

a height of the neck support member measured from a top surface of the elevated ramp to an upper surface of the neck support member and defined by a neck height of the user plus a compression allowance height representing an amount of vertical compression of the compressible pillow material under load during use; and a length of the neck support member defined by a neck length of the user; and, a concave depression positioned posterior to the neck support member and configured to receive and support the head of the user after the head of the user is tilted rearward relative to the neck support member;

a raised generally cylindrical left side-sleeping support region positioned adjacent a left side of the central sleeping support region and configured to support the head of the user in a left lateral recumbent sleeping position, the left side-sleeping support region comprising:

a height of the left side-sleeping support region defined by a shoulder height of the user plus a compression allowance height representing an amount of vertical compression of the compressible pillow material under load during use; and, a generally circular top surface of the left side-sleeping support region inclined relative to a reference plane of a bottom surface of the left side-sleeping support region, the top surface of the left side-sleeping support region extending downward toward the central sleeping support region and being inclined at an angle of between 5-15 degrees;

a raised generally cylindrical right side-sleeping support region positioned adjacent a right side of the central sleeping support region and configured to support the head of the user in a right lateral recumbent sleeping position, the right side-sleeping support region comprising:

a height of the right side-sleeping support region defined by a shoulder height of the user plus a compression allowance height representing an amount of vertical compression of the compressible pillow material under load during use; and, a generally circular top surface of the right side-sleeping support region inclined relative to a reference plane of a bottom surface of the right side-sleeping support region, the top surface of the right side-sleeping support region extending downward toward the central sleeping support region and being inclined at an angle of between 5-15 degrees.

2. The pillow of claim 1, wherein a height of the elevated ramp comprises a height of 2 inches.

3. The pillow of claim 1, wherein the top surface of the left side-sleeping support region and the top surface of the right side-sleeping support region each further comprise a crescent-shaped ear recess configured to reduce pressure on an ear of the user while permitting variation in head tilt.

4. The pillow of claim 1, wherein the pillow further comprises two or more layers.

5. The pillow of claim 4, wherein the two or more layers further comprise:

a base layer configured to provide structural support to the pillow during use;

a cushion layer positioned above the base layer and configured to deform under load to conform to anatomical contours of a sleeper; and, a contact layer positioned above the cushion layer and configured to provide an interface between the pillow and a user's skin.

6. The pillow of claim 1, wherein the concave depression comprises a depth between 1-3 inches.

7. The pillow of claim 1, wherein, the left side-sleeping support region and the right side-sleeping support region are mirror images.

* * * * *